US005938354A

United States Patent [19]

Yasui et al.

[11] Patent Number: 5,938,354

[45] Date of Patent: Aug. 17, 1999

[54] IMAGE FORMING APPARATUS

[75] Inventors: Tsuneo Yasui, Nagoya; Akira Sago, Seto; Kazuhiko Matsuda, Kounan; Hakudai Kondo; Masashi Suzuki, both of Nagoya, all of Japan

[73] Assignee: Brother Kogyo Kabushiki Kaisha, Aichi-ken, Japan

[21] Appl. No.: 08/886,439

[22] Filed: Jul. 2, 1997

[30] Foreign Application Priority Data

Jul. 2, 1996 [JP] Japan ..... 8-172227

[51] Int. Cl.[6] ..... B41J 11/56

[52] U.S. Cl. ..... 400/621; 101/484

[58] Field of Search ..... 400/611, 613.1, 400/621, 621.1, 118.3, 621.2; 101/484; 242/357; 226/20, 45

[56] References Cited

U.S. PATENT DOCUMENTS

| | | | |
|---|---|---|---|
| 3,915,090 | 10/1975 | Horst et al. | 101/486 |
| 4,025,025 | 5/1977 | Bartel et al. | 400/621 |
| 4,426,883 | 1/1984 | Inoue et al. | 33/733 |
| 4,485,982 | 12/1984 | St. John et al. | 400/118.3 |
| 4,815,374 | 3/1989 | Remy | 101/485 |
| 4,922,294 | 5/1990 | Nakagami et al. | 101/485 |
| 4,925,121 | 5/1990 | Tapscott | 400/118.3 |
| 4,926,048 | 5/1990 | Lerner et al. | 101/484 |
| 4,966,352 | 10/1990 | Nuttin | 101/483 |
| 5,187,376 | 2/1993 | Hashimoto et al. | 101/484 |
| 5,241,483 | 8/1993 | Porret et al. | 101/484 |
| 5,268,766 | 12/1993 | Nakadai | 400/621 |
| 5,489,158 | 2/1996 | Wang et al. | 400/103 |
| 5,727,887 | 3/1998 | Webster et al. | 400/611 |
| 5,751,303 | 5/1998 | Erickson et al. | 347/16 |

*Primary Examiner*—Eugene Eickholt
*Attorney, Agent, or Firm*—Kane, Dalsimer, Sullivan, Kurucz, Levy, Eisele and Richard, LLP

[57] ABSTRACT

Disclosed is an image forming apparatus for forming an image on roll paper. The image forming apparatus is provided with a printing head to form an image in accordance with an image data, a sheet feed mechanism to feed the roll paper, and a cutter which cuts out the printed portion of the roll paper. The image forming apparatus is further provided with an information recording system which records information related to the roll paper on downstream side of the portion at which the cutter cuts the roll paper.

19 Claims, 7 Drawing Sheets

IMAGE FORMING APPARATUS

BACKGROUND OF THE INVENTION

The present invention relates to an image forming apparatus for forming an image on roll paper.

Recently, an image forming apparatus, e.g., a printer, a copier and the like, which can form an image on large paper, for example A0 size paper, has been suggested. Most of these image forming apparatuses use, as a recording medium, so-called, roll paper which is a continuous sheet of paper wound around a core.

In an example of such an image forming apparatus, a roll paper is rotatably supported. The roll paper is then unrolled (drawn therefrom), an image is formed on the unrolled roll paper, and then the roll paper on which the image has been formed is ejected from an outlet of the image forming apparatus. The ejected roll paper may be cut out automatically, or manually to have a predetermined or desired length.

There are many kinds of materials for the roll paper, and these materials should be used properly according to an intended purpose. For example, for an indoor panel or the like, a synthetic paper (e.g., so-called YUPO paper) which is inexpensive and superior in strength is used, while for an outdoor signboard or the like, a vinyl chloride film which is superior in resistance to light is used.

However, it is often difficult to distinguish between certain types of roll paper. For example, it is difficult to distinguish between a white film and a white super-glossy film, between a white mat film and a photographic mat film, and the like. When forming an image, it is necessary to distinguish a roll paper carefully and select an appropriate roll paper suited for an intended purpose.

Further, in the case of roll paper having poor light resistance such as glossy paper (so-called woodfree paper), the surface of the roll paper at the periphery of the roll may become discolored if stored for a long time. Therefore, for roll paper which has been left for a long time since last used, it may be necessary to remove an outermost single turn of the roll paper before the roll paper is used.

Thus, conventionally, in order to manage the roll papers reliably, the roll papers must be classified and stored properly after each use so that the types of the roll paper can be distinguished easily.

Further, when the remaining amount of the roll paper becomes relatively low, an user has to determine, when a printing job is to be executed, whether the remaining amount of the roll paper is sufficient to execute the printing job. It may be difficult to judge the remaining amount accurately by sight, and in such a situation, the user tends to use another roll paper having a large amount of remaining paper. As a result, the number of stocked rolls having small amount of roll paper increases.

SUMMARY OF THE INVENTION

It is therefore an object of this invention to provide an image forming apparatus which allows relatively easy management of the roll paper.

For the above object, according to the invention, there is provide an image forming apparatus for forming an image on roll paper, comprising: a paper supporter which supports the roll paper; a paper transport system which transports the roll paper from the paper supporter; an image forming system which forms an image on the roll paper which is transported by the paper transport system; a cutter which cuts out the roll paper; a paper discharge portion which discharges the roll paper from the image forming apparatus; and an information recording system which records information related to the roll paper supported by the paper supporter on upstream side of a portion of the roll paper at which the cutter cuts the roll paper.

With this apparatus, the information is recorded at the leading end of the remaining roll paper, an operator recognizes the individual roll paper. Thus, management of the roll paper can be facilitated.

In particular, the information includes information regarding material of the roll paper.

Alternatively or optionally, the information includes information regarding a date when the roll paper was used previously.

Optionally, the apparatus may include a removing system which removes an area of the roll paper on which the information is prerecorded when the image forming means forms an image on the roll paper.

Thus, the prerecorded information does not affect the image which is formed in accordance with an image data.

Further optionally, the apparatus includes a selecting system which allows an operator to select whether the information recording system records the information. Therefore, if, for example, the information is not necessarily be formed, forming of the information can be inhibited.

Optionally, the information includes at least one record in character representation. Thus, an operator can easily recognize the information, and manage the roll paper.

Further optionally, the information includes at least one record in bar-code representation. Accordingly, the information can be handled by a computer or the like, which may facilitate management of the roll paper.

Still optionally, a bar-code reader may be provided in the apparatus to read the record in the bar-code representation.

Further, the apparatus may include a display unit, and the information read by the bar-code reader may be decoded and displayed on the display.

Yet optionally, the apparatus may be provided with a data input system through which a remaining amount of the roll paper is input.

Further, the apparatus is provided with a feeding amount detector which outputs signal representative of a feeding amount of the roll paper.

The current remaining amount of the roll paper can be calculated based on the remaining amount input through the inputting system and the signal output by the feeding amount detector.

Furthermore, the image forming apparatus further comprises a display unit which displays the information.

Still further, the apparatus includes an exchange detecting system which detects whether the roll paper has been exchanged.

Furthermore, the apparatus includes an information input system with which an initial information related to a newly loaded roll paper is input.

Still optionally, the information recording system generates the information to be printed on the roll paper in accordance with the initial information.

Furthermore, the apparatus comprises an exchange detecting system which detects whether the roll paper has been exchanged, and wherein the information input system requires information related to an exchanged roll paper.

According to another aspect of the invention, there is provided an image forming method of an image forming apparatus, comprising: transporting roll paper from a paper supporter supporting the roll paper; forming an image on the roll paper transported from the paper supporter; recording information related to the roll paper supported in the paper supporter after the image is formed on the roll paper; and discharging the roll paper from the image forming apparatus.

According to the above-described method, the information regarding the roll paper is recorded after image is formed in accordance with, for example, a printing data transmitted from an external device. Since the information regarding the roll paper is automatically formed, management of the roll paper when it is unloaded from the printer is facilitated.

Optionally, the discharging step comprises a step of cutting the roll paper at a position between a portion where the image is formed at the step of forming an image and a portion where the information related to the roll paper is recorded at the step of recording information.

DESCRIPTION OF THE PREFERRED EMBODIMENTS

Embodiments of the invention will be described with reference to the accompanying drawings.

Figure 1:
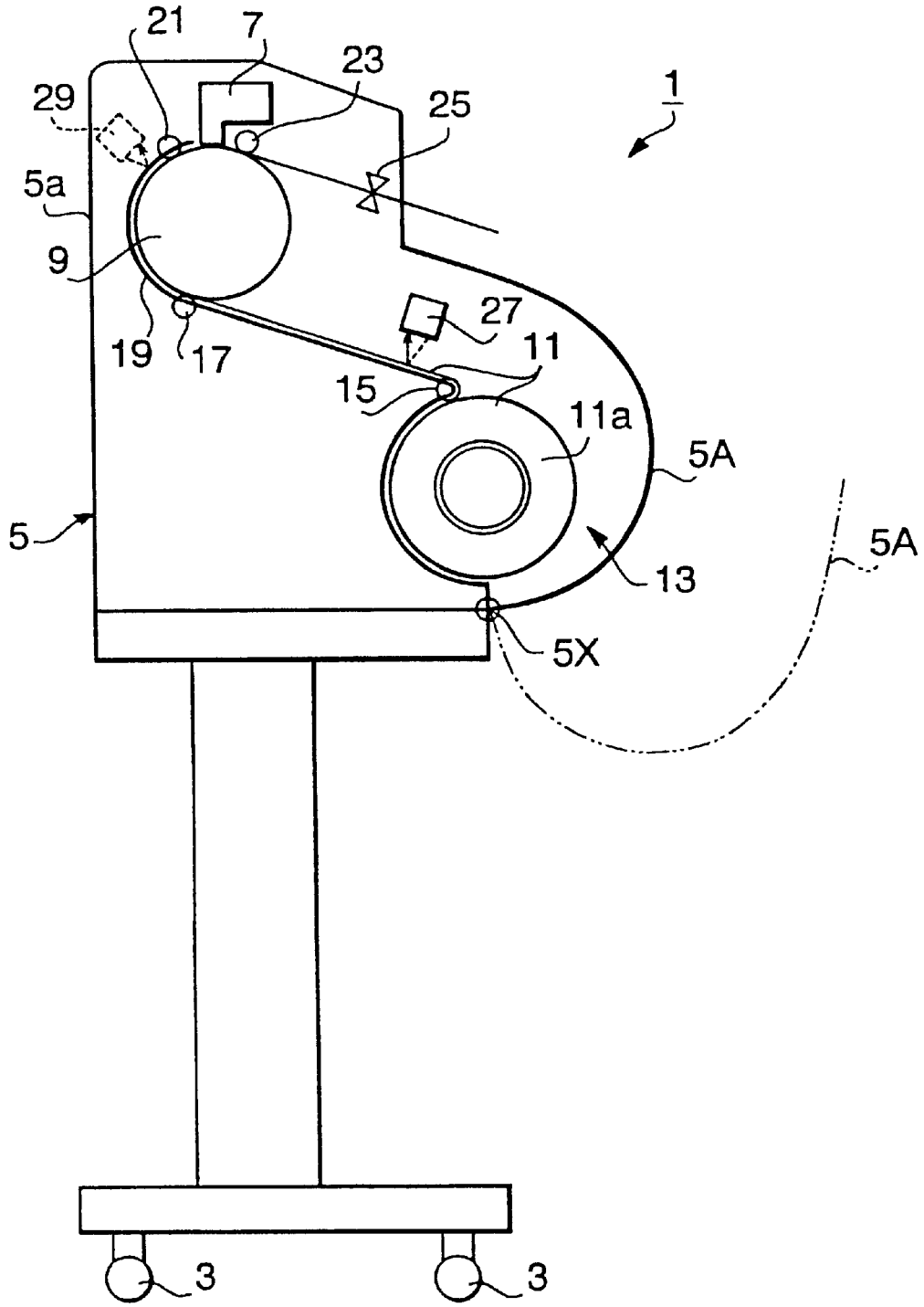
FIG. 1 is a schematic side view of a printer according to an embodiment of the invention.

FIG. 1 is a schematic side view of a printer 1 embodying the present invention.

As shown in FIG. 1, the printer 1 includes a frame 5 which is provided with casters 3 in order to be easily movable. The frame 5 includes an image forming area 5*a* and a storage space 13. A portion of the frame 5 around the storage space 13 is formed to be an openable cover 5A which rotates about an axis 5X to open and close. A platen roller 9 is rotatably supported in the image forming area 5*a* and roll paper 11 is rotatably supported in the storage space 13. By rotatably opening the cover 5A as shown by a phantom line in FIG. 1, the roll paper 11 can be exchanged. Axes of rotation of the platen roller 9 and the core 11*a* of the roll paper 11 are arranged to be parallel. As will be described in detail later, opening and closing of the cover 5A are detected in order to determine whether the roll paper 11 is exchanged.

The roll paper 11 is fed along a paper path such that the roll paper 11 is led from the storage space 13, around a straightening roller 15, past a graduation detector 27, between a guide roller 17 and the platen 9, is guided by a guide plate 19 around the circumference of the platen 9, past a bar-code reader 29, is fed by a first feed roller 21 to pass between a recording head 7 and the platen 9, and is then fed by a second feed roller 23 to a cutter 25 before being ejected from the printer 1.

The elements on the paper path are now described in more detail.

The straightening roller 15 is arranged to bend the roll paper 11 in a reverse direction to the direction in which the roll paper 11 is wound on the core 11*a* in order to straighten or remove curling tendency of the roll paper 11.

The guide roller 17 is provided to accurately feed the roll paper 11 into the space between the guide plate 19 and the platen roller 9. The first and second feed rollers 21 and 23, provided upstream and downstream, along the sheet feed direction, from the recording head 7, respectively, press the roll paper 11 against the platen roller 9 to ensure that the roll paper 11 is held in position when the recording head 7 forms an image on the roll paper 11.

The recording head is an ink-jet type printing head, and movable in a direction parallel to the axis of the platen roller 9. The structure of the ink-jet type printing head is well-known and the description therefore is omitted herein. It should be noted that the head 7 is not necessarily be the ink-jet type, but various types of printing head can be used, The cutter 25 cuts the roll paper 11 to cut out the printed portion of the roll paper 11 which is ejected from the printer 1. As described later, the cutter 25 is electrically driven to cut the roll paper 11. Alternatively, a manually operable cutter may be used.

Figure 2:
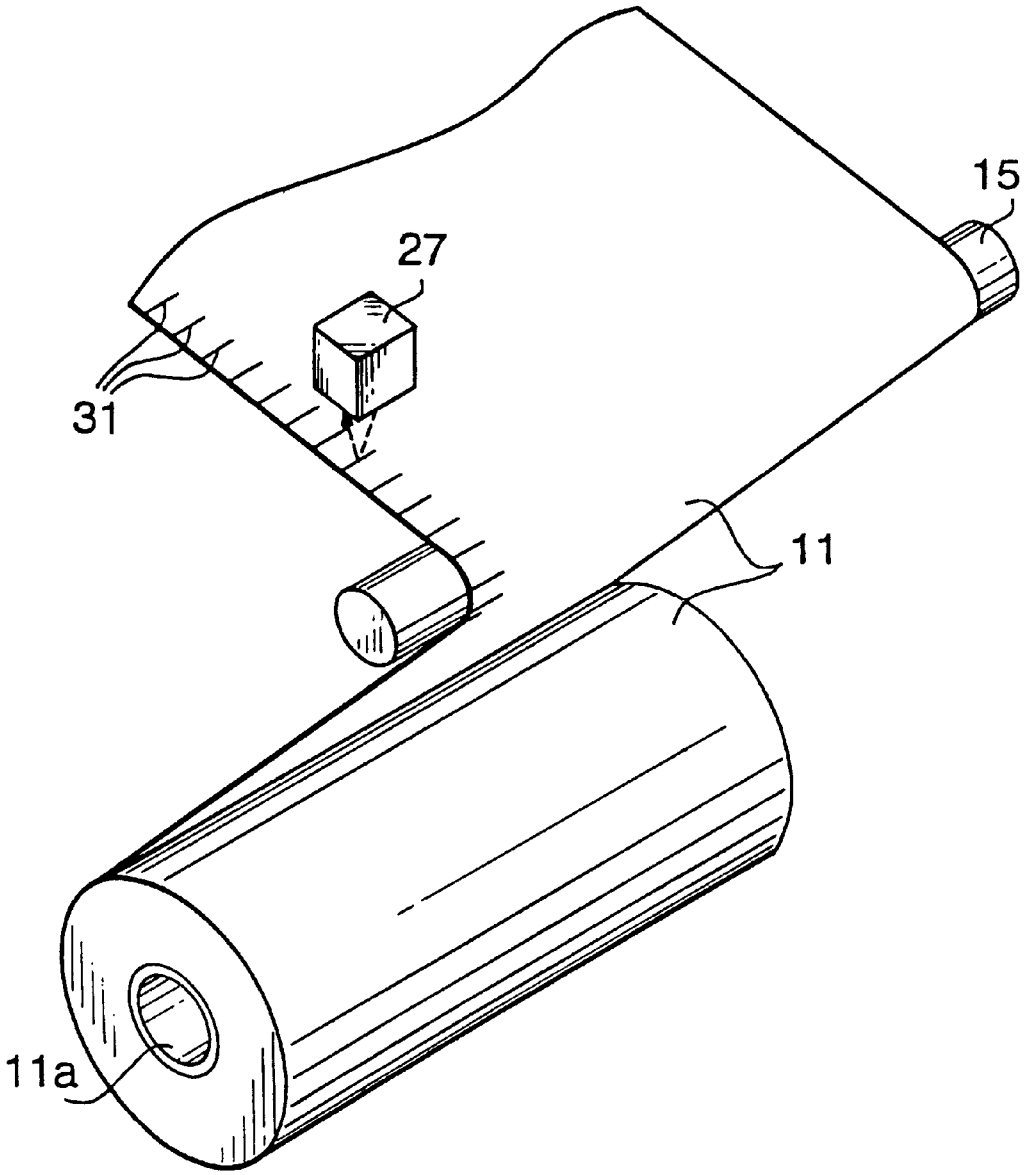
FIG. 2 is a schematic perspective view of roll paper and a detector.

As shown in FIG. 2, the graduation detector 27 is arranged to optically read graduation markings 31 which are uniformly spaced on a single edge of the roll paper 11. In this embodiment, the graduation markings 31 are provided on a non-recording surface of the roll paper 11 (i.e. on the back side of the roll paper 11) such that an image recorded on the roll paper 11 will not be affected thereby. However, if necessary, for example, if the graduation markings 31 are provided on the recording surface of the roll paper 11, the portion of the roll paper 11 on which the graduation markings 31 are provided may be removed with an appropriate cutter (not shown) or the like disposed on downstream side from the graduation detector 27.

Figure 3:
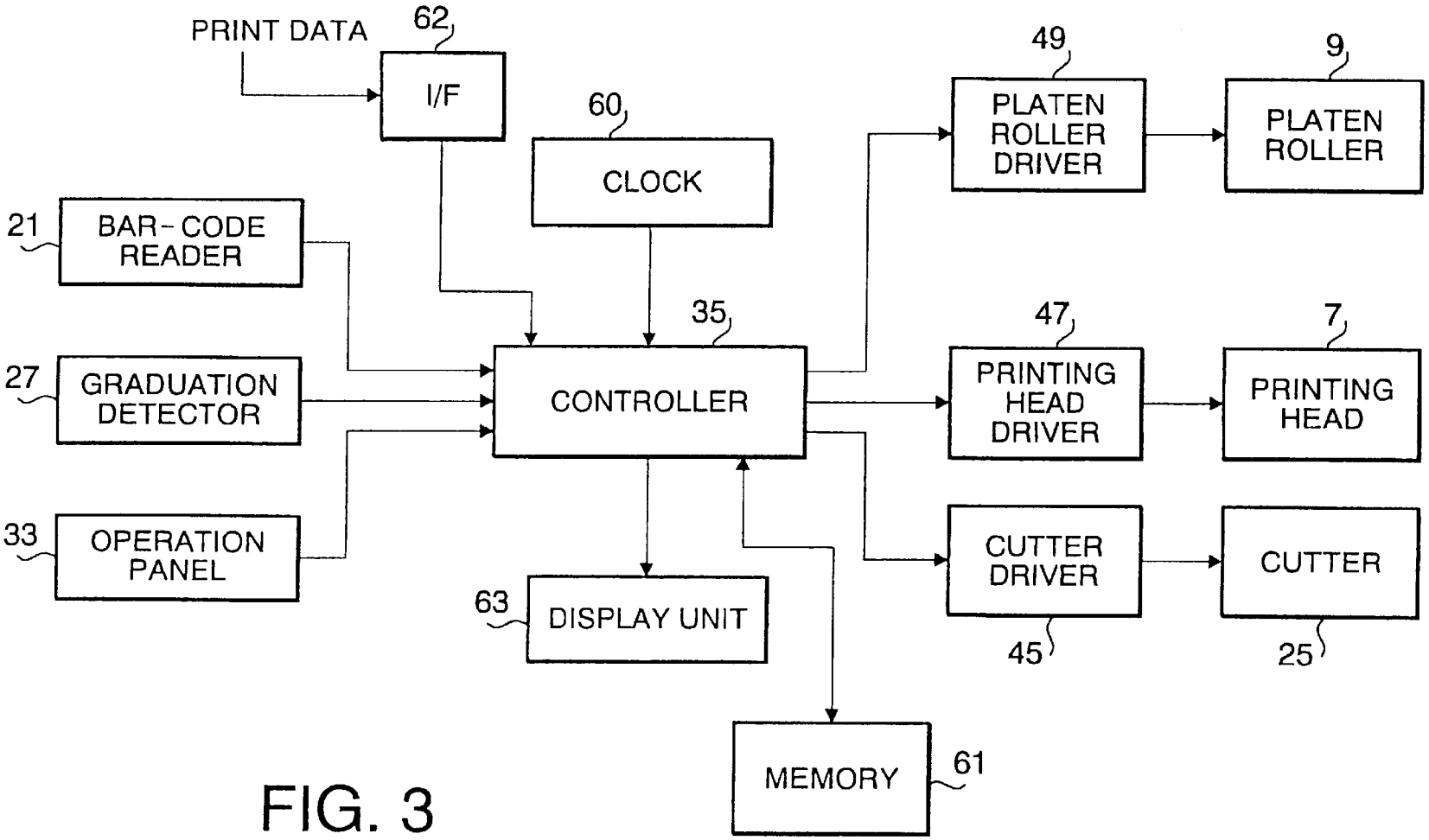
FIG. 3 is a block diagram of a control system of the printer of FIG. 1.

As described in more detail later, the bar-code reader 29 may be provided if a bar-code 59 (refer to FIG. 6) is recorded on the roll paper 11. Specifically, the bar-code reader 29 is not required in the first embodiment since the bar code is not formed in the first embodiment, while, in a second embodiment, the bar code is recorded on the recording paper 11, and accordingly the bar-code reader 29 should be provided in the printer 1 in the second embodiment FIG. 3 is a block diagram showing a control system of the printer 1. As shown in FIG. 3, the printer 1 further includes an operation panel 33 and a control circuit 35. The control circuit 35 receives signals from the operation panel 35, the graduation detector 27, and the bar code reader 29. Further the printer 1 is provided with a clock 60 which measures date and time, and a display unit 50 for displaying various operation parameters on a screen thereof. The control circuit 35 controls a platen roller driver 49 to control the movement of the platen roller 9, a recording head driver 47 to drive the recording head 7, and a cutter driver to control the cutter 25 to cut the roll paper 11 according to the received signals. Printing data is input through an interface (I/F) 52. Further, the controller 35 is connected with a memory S1 for storing various data. Preferably, the control circuit 35 receives signals from the operation panel 33 indicating operating status of operable members provided thereon. Operating status may be displayed on the screen of the display unit 50.

Operation of the control circuit 35 according to a first embodiment of the invention will be described with reference to a process illustrated by a flowchart in FIG. 6. As mentioned above, in the first embodiment, the bar-code reader 29, which is shown by broken lines in FIG. 1, is not used.

Figure 4:
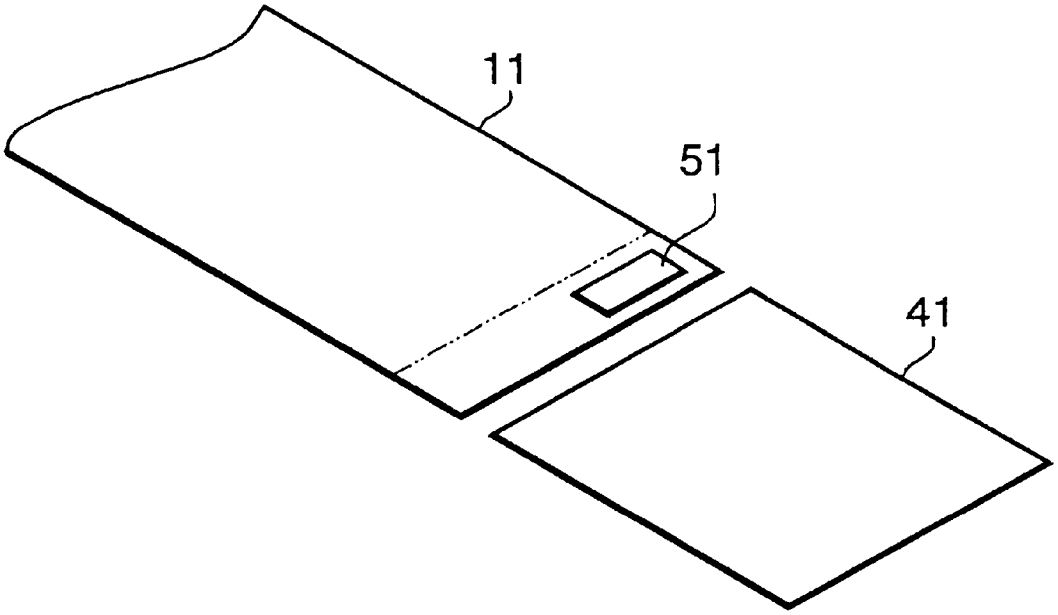
FIG. 4 shows a roll paper on which information is formed.
Figure 5:
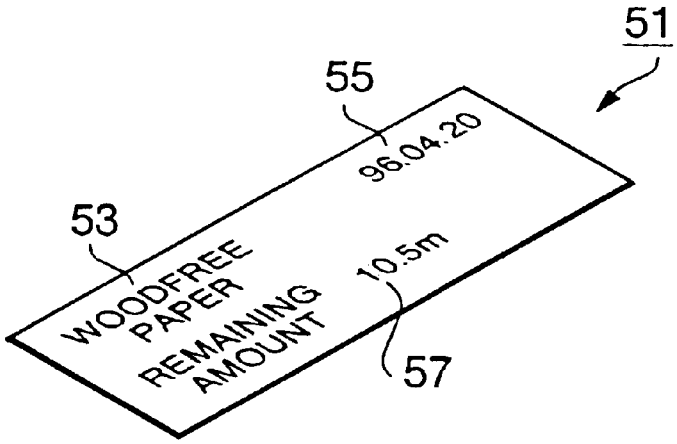
FIG. 5 shows an example of the information formed on the roll paper.

According to the first embodiment, when a printing job is finished and the roll paper 11 is cut by the cutter 25 information 51 is printed at the leading end portion 11A of the remaining paper 11 as shown in FIG. 4. FIG. 5 is an enlarged view of an example of the recorded information 51. The information 51 includes a frame 52, and within the frame 52, a type 53 of the paper 11, the remaining amount 57, and the date 55 when the paper is last used. It should be noted that items and the number of items to be printed as the information 51 depend on how the roll paper 11 is managed and are not limited to the above three.

Figure 6:
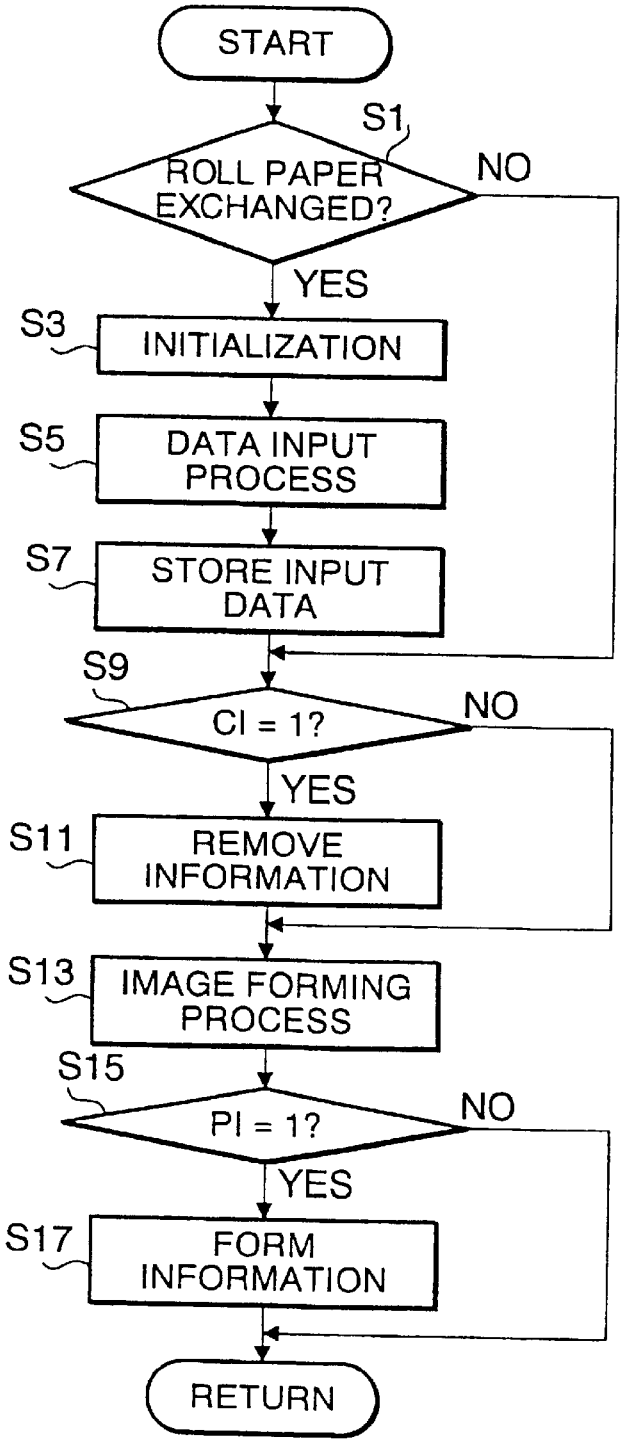
FIG. 6 is a flowchart illustrating a process for a printing job according to a first embodiment of the invention.

The process shown in FIG. 6 begins when a main switch (not shown) on the operation panel 33 is turned ON and power is supplied to the printer 1.

At step S1, the controller 35 determines whether the roll paper 11 is exchanged or not. This detection is made by monitoring opening and closing of the cover 5A. That is, if the cover 5A is once opened and then closed, the controller 35 determines that the roll paper 11 is exchanged. Alternatively, the detection of the exchange of the roll paper 11 may be done by monitoring existence of the roll paper 11 That is, if absence of the roll paper 11 is detected, and then existence of the roll paper 11 is detected, the controller 35 determines that the roll paper 11 is exchanged.

If the controller 35 determines that the roll paper 11 has been exchanged (Yes at S1), an initialization process is executed at S3. In the initialization process, the controller 35 sets flags PI and CI to "1" and "0", respectively. The flag PI is indicative of whether the information 51 is to be printed or not: if PI is "1", the information 51 is to be printed; and if PI is "0", the information 51 will not be printed. The flag CI is indicative of whether the information 51 printed on the leading edge portion 11A of the roll paper 11 is to be cut out: if CI is "1", the information 51 will be cut out by the cutter 25; and if CI is "0", the information 51 is not cut out. Further, in the initialization process, parameters indicating the material of the roll paper 11, the remaining amount, and the date when the roll paper 11 is last used are cleared (i.e., set to default values).

At S5, an operator is required to input information related to the newly loaded roll paper 11 through the operation panel 33. At this stage, the flags PI and CI can also be set through the operation panel 33. Further, the type of the roll paper 11, the last date when the roll paper 11 is used, and the remaining amount are input through the operation panel 33. In the embodiment, the type of the roll paper 11 is input such that a list of materials are displayed on the screen of the display unit 63 and one of the material is selected with the operation panel 33. If the roll paper 11 is a newly used paper, no date is input as the last date, and the entire length of the roll paper 11, which may be indicated on a package of the new roll paper, is input as the remaining amount. Further, the material of the roll paper 11, which may also be indicated on the package, is input. If the roll paper 11 has been used before, the information related to the newly loaded roll paper 11 is input, through the operation panel 33, in accordance with the information 51 printed on the leading end portion 11A of the roll paper 11.

At S7, the data input at step S5 is transferred and stored in the memory 61.

If the controller 35 determines at S1 that the roll paper 11 has not exchanged (No at S1), control proceeds from S1 to S9.

At step 99, the controller 35 determines whether the information 51 is to be removed from the roll paper 11 by checking the flag CI. If the flag CI has been set to "1" and the prerecorded information 51 is to be removed (S9: YES), control proceeds to step S11. At step S11, the position of the roll paper 11 is adjusted such that the line 11B is located at the cutter 25, and the cutter 25 is activated to remove the portion 11A of the roll paper 11 on which the information 51 is printed. It should be noted that the line 11B is not an actually printed line but an imaginary line and indicated in the drawing for showing the position at which the roll paper 11 is cut.

In the case where the information 51 has not been recorded on the roll paper 11, for example, when the roll paper 11 has not been used previously, i.e., the last date used has not input at S5, nothing is done at S11 even if the flag CI is set to "1", and control will proceed to step S13.

At step S13, a known image forming process is performed. For example, the controller 35 drives the platen roller driver 49 and the head driver 47 according to image data received from an external source (not shown) such as a personal computer or the like via the interface 62 and stored in the memory 61, and an image corresponding to the data is formed on the roll paper 11. In particular, in the image forming process, the recording head 7 and the platen roller 9 are also controlled according to the information 51 regarding the material of the roll paper 11. For example, an ink jet amount of the ink jet type printing head 7 may be varied depending on the material of the roll paper 11. The image forming process also includes steps such that after the image is formed, the roll paper 11 is advanced and the cutter 25 is operated to cut the roll paper 11 and eject the printed portion 41 from the printer 1 (See FIG. 5).

At step S15, the control circuit 35 determines whether or not new information 51 is to be recorded according to the flag PI. If the information 51 is not to be recorded (S15: NO), the process ends (i.e., S17 is not executed).

When new information 51 is to be recorded (S15: YES), control proceeds to step S17 and the new information 51 is recorded, based on the data input at S5 and stored in the memory 61, on the roll paper 11 as in the example shown in FIGS. 4 and 5. As shown in FIG. 4, assuming that an image has been formed on the roll paper 11 and cut by the cutter 25 to form the printed sheet 41, the control circuit 35 controls the platen roller 9 and the recording head 7 to record the information 51 just upstream of the position where the cutter 25 cuts off the image sheet 41. It should be noted the information 59 is recorded before the image sheet 41 is cut out. The information 59 is recorded immediately after the image forming process has been finished, on the upstream side of the roll paper 11. Thereafter, the roll paper 11 is fed by a predetermined amount so that a portion between the printed portion 41 and the information 59 is located at the cutter 25. Accordingly, when the cutter 25 is actuated to cut off the image sheet 41, the portion of the roll paper 11 bearing the information 59 remains inside the printer 1. Alternatively, it may be possible that the information 59 is recorded after the image sheet is cut out. In such a case, the roll paper 11 is reversely fed after the image sheet 41 is cut out so that the leading end portion 11A is located at the recording head 7.

FIG. 5 shows an example of a format in which the information 51 may be recorded. In particular, the material 53 of the roll paper 11, the current date 55, the remaining amount 57 of the roll paper 11 (all in character format), and the frame 52 are printed.

Note that the material of the roll paper 11 is input at S5 and stored in the memory 61, and the current date 55 is input from the clock 60.

The remaining amount 57 is calculated by the control circuit 35 by subtracting the current use of the roll paper 11 as detected by the graduation detector 27 from the remaining amount which is input at S5 and stored in the memory 61 at step S7.

Since the printer 1 is able to record the information 51 on the roll paper 11, the information 51 is easily visible such that in a situation where there are many types of roll paper, finding and selecting an appropriate roll paper may be done quickly and easily. Also, since the information 51 includes the date 55 last used, the roll paper can be appropriately managed to avoid discoloring and the like. Still further, since the information 51 includes the remaining amount 57, the maximum image size that can be formed on the roll paper (i.e., the maximum consuming amount of the roll paper) can be easily determined.

Thus, the use of the printer 1 extremely facilitates the management of roll paper 11

Further, since the printer 1 includes a setting in which the information 51 may be removed (cut off) from the roll paper 11, the information 51 does not need to be separately removed from the image sheet 41 after the printed sheet 41 is ejected from the printer 1.

Still further, since the printer 1 can also be set such that the information 51 is not recorded, in a case when the information 51 is not required, for example, when many images are to be formed in a row, the information 51 will not be recorded each time, thus avoiding a waste of the roll paper 11 and the like.

Although the structure and operation of an image forming apparatus is described herein with respect to the preferred embodiments, many modifications and changes can be made without departing from the spirit and scope of the invention. For example, the information 51 may include additional data as required, for example, the date 55 may also include the time of last use.

Next, operation of the controller 35 according to a second embodiment will be described with reference to FIG. 7.

In the second embodiment, information 51M is printed on the leading end portion 11A of the roll paper 11. As shown in FIG. 7, the information 51M is similar to the information 51 except that the information 51M is further provided with a bar-code 59 carrying a predetermined information. In the second embodiment, the bar-code 59 represents the same information printed in the form of characters, i.e., the material 53, the last date 55 and the remaining amount 57. Further, as described above, the printer 1 is provided with the bar-code reader 29 for reading the bar-code included in the information 51M in the second embodiment.

Figure 7:
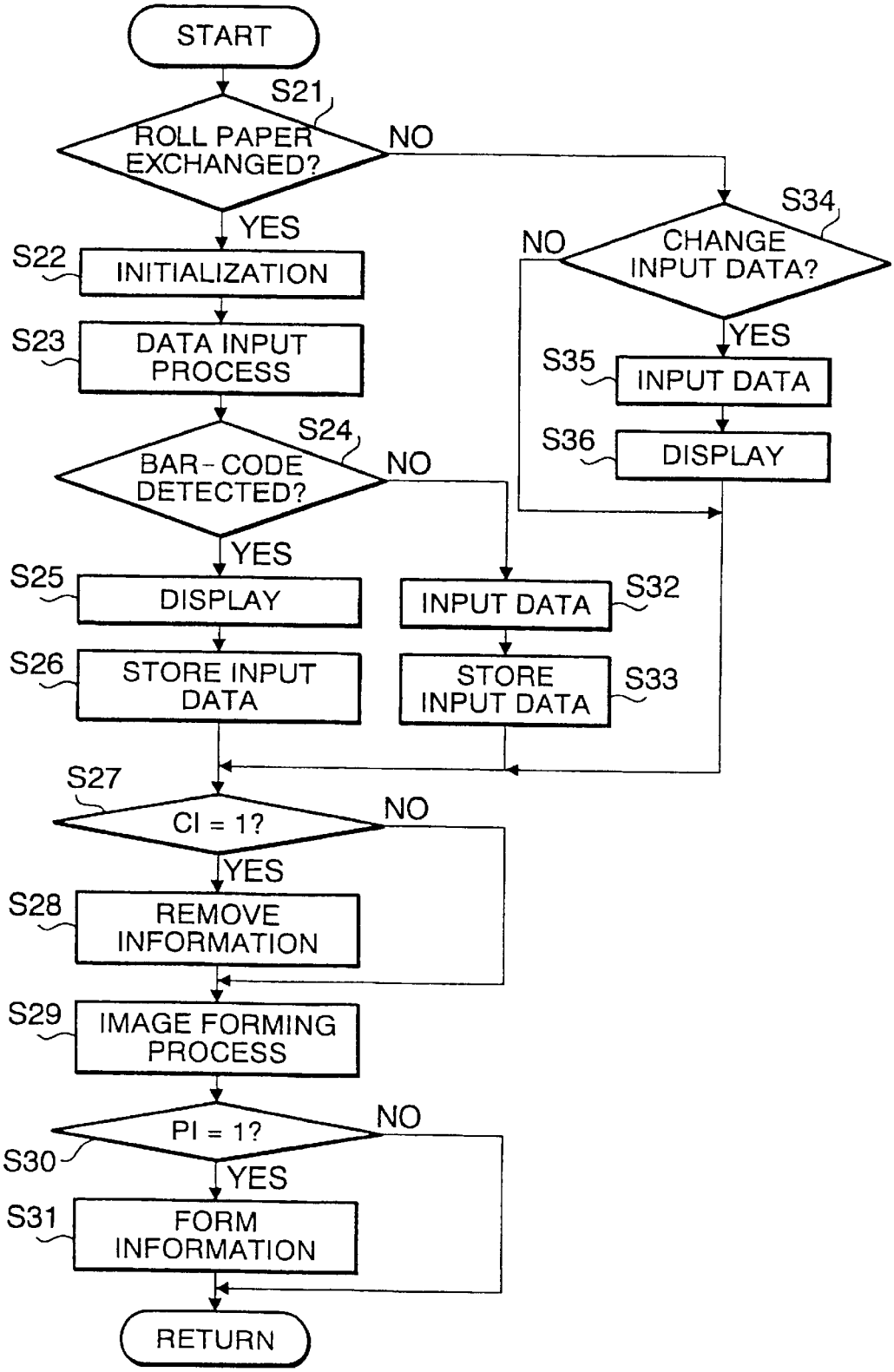
FIG. 7 is a flowchart illustrating a process for a printing job according to a second embodiment of the invention.
Figure 8:
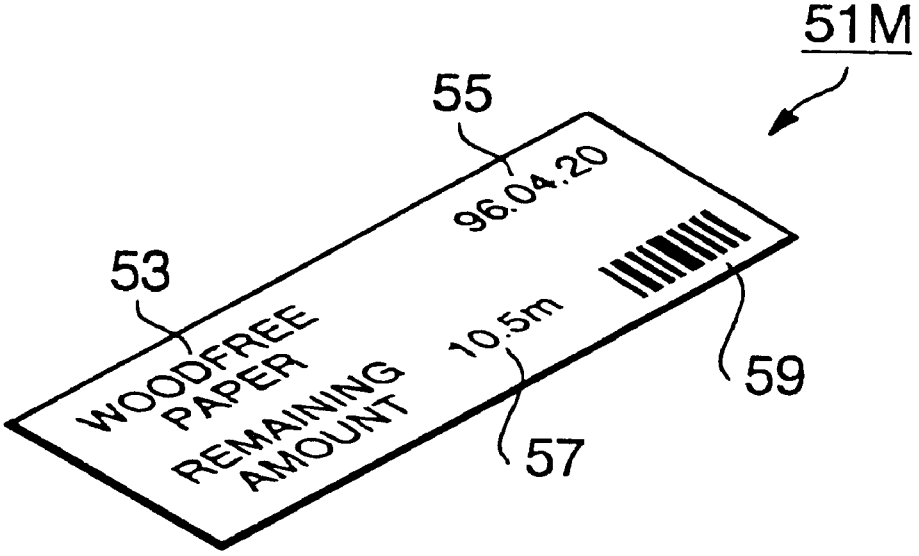
FIG. 8 shows an alternative example of the information formed on the roll paper.

In the process shown in FIG. 7, at S21, the controller 35 determines whether the roll paper 11 has been exchanged by detecting whether the cover 5A has been once opened and then closed. If the roll paper 11 has been changed (Yes, at S21), control goes to step S22 at which an initialization process is done. That is, in the initialization process, the controller 35 sets flags PI and CI to "1" and "0", respectively. Then, in S23, the data input is executed to set the flags CI and PI through the operation panel 33.

The, at S24, it is determined whether a bar-code 59 is detected or not.

In the printer 1, when the roll paper 11 is newly loaded, the leading end of the roll paper 11 is placed at a predetermined position within the paper path, for example, the leading end of the roll paper 11 is slightly engaged in a nip between the platen roller 9 and the roller 17. Then, the controller 35 controls the platen roller driver 49 to rotate the platen roller 9 so that the sheet is fed In accordance with the signal output by the graduation detector 27, the controller 35 controls the platen roller driver 49 to stop rotating the platen roller 9 such that the leading end portion 11A is located at the bar-code reader 29. Alternatively, the bar-code reader 29 may be used as a sensor for detecting the leading end of the roll paper 11, or another sensor for detecting the leading end of the roll paper 11 may be provided.

If the bar-code 59 is detected by the bar-code reader 29, the bar-code 59 is decoded, and the information related to the loaded roll paper 11 (i.e., the material, the remaining amount, and the last date used) is displayed on the screen of the display unit 63. Then, at S26, the data read at S25 is.stored in the memory 61 as the data related to the loaded roll paper 11. Thereafter, the process similar to steps S9 through S17 is executed at S27 through S31. It should be noted, that in S31, when the information 51 is printed, according to the second embodiment, the bar-code 59 is also printed.

If the roll paper 11 is new paper. i.e., it has not yet used previously, the bar-code has not been printed. In such a case, the controller 35 fails to detect the bar-code (No at S24) even if the leading end of the roll paper 11 is transported from the position nipped between the platen roller 9 and the roller 17 to the position facing the bar-code reader 29. Then, control goes to S32. If the roll paper 11 is a newly used paper, current date is input as the last date, and the material and the entire length of the roll paper 11, which may be indicated on a package of the new roll paper, are input by an operator. Thus input data is stored in the memory 61 at S33, and control proceeds to S27.

At S21, if it is determined that the roll paper 11 has not exchanged (No at S21), the controller 35 displays a message on the screen of the display unit 63 to the operator requiring instruction on whether the data related to the loaded roll paper is to be changed. If no data is to be changed, the operator inputs command indicating no data is to be changed. Then, determination at S34 is made NO, and control proceeds to S27. If there is data to be changed, the operator inputs a command whether the information 51M is to be printed or not and whether the information 51M printed on the leading edge portion 11A of the roll paper 11 is to be cut out or not. Then, the determination at S34 is made YES, and control proceeds to S35 where data is updated by means of the operation panel 33, and stored in the memory 61. The updated data is displayed on the screen of the display unit 63 at S36.

As described above, according to the second embodiment, when the bar-code 59 is printed on the leading end portion 11A of the roll paper 11, the bar-code is read, decoded and then displayed on the screen of the display unit 63. Therefore, the operator can always recognize the data of the loaded roll paper 11. It should be noted that, on the screen of the display unit, instead of the remaining amount as decoded, an actual remaining amount calculated based on the remaining amount and the output of the graduation detector 27 can be displayed.

Further, when the roll paper is removed from the printer 1 and stored, management of the roll paper 11 can be made easily In particular, since the bar code is provided, a computerized management of the roll paper 11 can be done easily.

Note that in the second embodiment, the bar-code is read by the built-in bar-code reader 29. However, it is possible to use an external bar-code reader.

In the second embodiment, the bar-code can be replaced with any computer-readable code For example, if the printer 1 is provided with an OCR system, characters can be used instead of the bar-code.

In the embodiments described above, the information 51 or 51M is printed by the printing head 7. However, it can be modified to employ a separate printing element for printing only the information related to the roll paper. Alternatively, instead of printing the information, a seal or the like on which the information is printed can be affixed.

In the embodiments described above, the remaining amount is calculated as the roll paper is fed. Therefore, if the printing data includes information indicative of the length of the paper to be used, the controller of the printer may determine whether the remaining amount is sufficient for printing the printing data. If such a determination is made, for example, warning can be output if the remaining amount is insufficient to print the received data completely.

Further, in the second embodiment, the controller detects the material automatically. Therefore, the embodiment may be modified such that the operator is required to input an intended material, and the controller examines whether the intended material is the same as the material of the loaded paper. In this case, it may also be possible to output the warning when the materials do not match.

The present disclosure relates to subject matter contained in Japanese Patent Application No. HEI 08-172227, filed on Jul. 2, 1996, which is expressly incorporated herein by reference in its entirety.

What is claimed is:

1. An image forming apparatus for forming an image on roll paper, comprising:

a paper supporter which supports the roll paper;

a paper transport system which transports the roll paper from said paper supporter;

an image forming system which forms an image on the roll paper which is transported by said paper transport system;

a cutter which cuts out the roll paper;

a paper discharge portion which discharges the roll paper from said image forming apparatus; and an information printing system which prints information on an upstream side of a portion of the roll paper at which said paper cutter cuts said roll paper, said information being related to the roll paper supported by said paper supporter;

wherein said information printing system prints said information on a portion, which remains after said cutter cuts out the roll paper, subsequent to said image forming system forming said image on said roll paper.

2. The image forming apparatus according to claim 1, wherein said information includes information regarding material of said roll paper.

3. The image forming apparatus according to claim 1, wherein said information includes information regarding a date when said roll paper was used previously.

4. The image forming apparatus according to claim 1, further comprising removing system which removes an area of said roll paper in which said information is printed when said image forming means forms an image on said roll paper.

5. The image forming apparatus according to claim 1, further comprising selecting system which allows an operator to select whether said information printing system prints said information.

6. The image forming apparatus according to claim 1, wherein said information includes at least one record in character representation.

7. The image forming apparatus according to claim 1, wherein said information includes at least one record in bar-code representation.

8. The image forming apparatus according to claim 7, further comprising a bar-code reader which reads said record in said bar-code representation.

9. The image forming apparatus according to claim 8, further comprising a display unit, said information read by said bar-code reader being decoded and displayed on said display.

10. The image forming apparatus according to claim 1, further comprising a data input system through which a remaining amount of said roll paper is input.

11. The image forming apparatus according to claim 10, further comprising a feeding amount detector which outputs signal representative of a feeding amount of said roll paper.

12. The image forming apparatus according to claim 11, further comprising a calculation system which calculates a current remaining amount based on said remaining amount input through said inputting system and said signal output by said feeding amount detector.

13. The image forming apparatus according to claim 1, further comprising a display unit which displays said information.

14. The image forming apparatus according to claim 1, further comprising an exchange detecting system which detects whether said roll paper has been exchanged.

15. The image forming apparatus according to claim 1, further comprising an information input system with which an initial information related to a newly loaded roll paper is input.

16. The image forming apparatus according to claim 15, wherein said information printing system generates said information to be printed on said roll paper in accordance with said initial information.

17. The image forming apparatus according to claim 16, further comprising an exchange detecting system which detects whether said roll paper has been exchanged, and wherein said information input system requires said initial information related to an exchanged roll paper.

18. An image forming method of an image forming apparatus, comprising:

transporting roll paper from a paper supporter supporting the roll paper;

forming an image on the roll paper transported from the paper supporter;

cutting said roll paper;

printing information on the roll paper after the image is formed, said information being printed on a portion of said roll paper which remains supported in the paper supporter after said roll paper is cut, said information relating to the roll paper; and discharging the roll paper from the image forming apparatus.

19. The image forming method according to claim 18, wherein said discharging step comprises a step of cutting the roll paper at a position between a portion where the image is formed at the step of forming an image and a portion where the information related to the roll paper is printed at the step of printing information.

* * * * *